US011654068B2

(12) United States Patent
Giap

(10) Patent No.: US 11,654,068 B2
(45) Date of Patent: May 23, 2023

(54) Z-SHAPE SLIDING BOARD UTILIZING GRAVITY-ASSISTANCE FOR PATIENT LATERAL TRANSFER

(71) Applicant: Brandon Cuongquoc Giap, Del Mar, CA (US)

(72) Inventor: Brandon Cuongquoc Giap, Del Mar, CA (US)

( * ) Notice: Subject to any disclaimer, the term of this patent is extended or adjusted under 35 U.S.C. 154(b) by 0 days.

(21) Appl. No.: 17/101,256

(22) Filed: Nov. 23, 2020

(65) Prior Publication Data

US 2022/0160561 A1 May 26, 2022

(51) Int. Cl.
*A61G 7/10* (2006.01)

(52) U.S. Cl.
CPC ..... *A61G 7/103* (2013.01); *A61G 7/1026* (2013.01); *A61G 7/1036* (2013.01)

(58) Field of Classification Search
CPC .... A61G 7/103; A61G 7/1036; A61G 7/1026; A63B 21/4037
See application file for complete search history.

(56) References Cited

U.S. PATENT DOCUMENTS

| | | | | |
|---|---|---|---|---|
| 5,036,557 A | | 8/1991 | Fales | |
| 5,067,188 A | | 11/1991 | Brantman | |
| 5,152,016 A | | 10/1992 | Becker | |
| 5,193,233 A | | 3/1993 | Miller | |
| 5,642,537 A | | 7/1997 | Johnson | |
| 5,704,081 A | * | 1/1998 | Bollinger | A61G 7/1026 5/81.1 T |
| 6,341,393 B1 | | 1/2002 | Votel | |
| 6,374,435 B1 | | 4/2002 | Leininger et al. | |
| 8,096,003 B2 | | 1/2012 | Schuster | |
| 2012/0079656 A1 | | 4/2012 | Lewis | |

(Continued)

FOREIGN PATENT DOCUMENTS

| | | |
|---|---|---|
| AU | 2007203380 A1 | 2/2008 |
| CA | 2713570 A1 | 3/2011 |

(Continued)

*Primary Examiner* — David R Hare
*Assistant Examiner* — Adam C Ortiz
(74) *Attorney, Agent, or Firm* — Donn K Harms

(57) ABSTRACT

The present invention provides an apparatus and method for lateral transfer of patient between two platforms. In particular the invention provides an apparatus for lateral transfer of patient that facilitates gravity assisted transfer of patient with low effort and high protection from injury. The invention comprise a curved board for gravity assisted lateral transfer of patient comprising a top surface and a bottom surface having rectangular holes punched at the ends of the curved board. The curved board comprise of an elevated portion, a middle slanted portion, and a lower portion wherein the elevated portion is substantially raised relatively to the lower portion. In an embodiment of the present invention, the elevated portion of the curved board can be configured to shove beneath the bed sheet and the lower portion of the curved board can rest on flat surface of the adjacent low levelled second flat surface thus facilitating gravity assisted lateral transfer of patient which is performed by nurses by gently sliding the patient from the elevated surface to the lower surface via the slanted surface on the z-shaped curved board.

2 Claims, 10 Drawing Sheets

(56) References Cited

U.S. PATENT DOCUMENTS

| | | | | |
|---|---|---|---|---|
| 2013/0180046 | A1* | 7/2013 | Davis, Jr. ..... | A61G 7/1074<br>5/81.1 HS |
| 2019/0201263 | A1* | 7/2019 | Depauw ..... | A61G 7/001 |

FOREIGN PATENT DOCUMENTS

| | | | |
|---|---|---|---|
| CN | 204306985 | U | 5/2015 |
| DE | 3806470 | C2 | 5/1991 |
| EP | 3245996 | A1 | 11/2017 |

* cited by examiner

Z-SHAPE SLIDING BOARD UTILIZING GRAVITY-ASSISTANCE FOR PATIENT LATERAL TRANSFER

CROSS-REFERENCE TO RELATED APPLICATIONS

This application claims the benefit of U.S. Provisional Patent Application No. 63/070,830, filed Aug. 27, 2020, which is incorporated by reference herein in its entirety.

FIELD OF THE INVENTION

The present invention relates to an apparatus designed to ease the transfer of a patient lying on a first flat surface to another flat surface adjacent to the first flat surface. In particular, the invention provides an apparatus that facilitates lateral transfer of patient utilizing gravity assistance without exposing patient or staff to back injury during such process.

BACKGROUND OF THE RELATED ART

Establishing a safe patient handling, mobility, and injury prevention standard for direct-care registered nurses and other health care workers is a critical component reasonably necessary for protecting the health and safety of nurses and other health care workers, addressing the nursing shortage, and increasing patient safety.

Manual handling of disabled patients may result in severe musculoskeletal injuries to caregivers. Moreover, it can cause caregiver injury and put patients at risk of falls, fractures, bruises, and skin tears. With age, healthcare workers statistically become more vulnerable to infections and musculoskeletal injuries.

Several other prior attempts to deal with such problems have been utilized as set forth below.

U.S. Pat. No. 5,036,557 to Fales discloses an apparatus includes a substantially rigid, planar board which bridges between the patient supports, and a stop secured to the bottom of the board which fits between the patient supports and abuts the side edge of the receiving patient support to prevent movement of the board as the patient is slid across it. The method relates to using the apparatus to slide a patient from one patient supporting surface to another, particularly on an incline where the first and second patient supports are at different heights.

U.S. Pat. No. 5,642,537A discloses a low-friction, substantially rigid, planar board which bridges between the beds and has a hinged anchor fin or plurality of such anchor fins on the lower surface that deploy from a folded position parallel to the plane of the board to a fixed position perpendicular to the plane of the board to fit between the beds. Once deployed, the anchor fin or fins prevent the board from sliding with the patient as the patient is moved to the second bed.

Patent Publication US20120079656A1 discloses a combination patient-transfer and intraoperative heater has top and bottom chambers separated by a barrier. The patient rests on the top chamber, which has plural apertures for discharge of temperature-controlled heated or cooled air at regulated pressure. Heated or cooled air is delivered to the area surrounding the patient, maintaining body temperature during anaesthesia. The bottom chamber has plural apertures. When air pressure is low or off, the bottom chamber is flat and un-inflated. When air pressure is increased, air enters the bottom chamber and the apertures emit air, creating an air cushion facilitating lateral movement of the lifter device.

Patent Publication CA2713570A1 discloses a patient transfer device that includes a mat, with an upper side and a gas permeable lower side. The mat includes a chamber between its upper and lower sides, which is operable to be in fluid communication with an air source such that when air flows into the mat, the air will flow into the chamber and through the gas permeable lower side to form an air film between the mat and a surface on which the mat is supported at its lower side. In addition, the lower side of the mat is substantially planar when the mat is inflated.

Patent Publication EP3245996A1 discloses a Board for lateral transfer of patients, of the type comprising a main body, flat, rigid or substantially rigid, that defines a top surface, a bottom surface and rounded side edges that join said surfaces, and a tubular cover that partially wraps the main body, characterised in that it comprises at least one fabric arranged between the main body and the tubular cover, and in that said fabric has two surfaces: a first that is joined to the main body and a second which, once the first surface is attached to the main body, remains facing the tubular cover with which it comes into contact, at least partially, when transferring the patient, with said second surface comprising a sliding material, with said fabric occupying at least one part of the surface that covers the tubular cover.

Patent Publication CN204306985U discloses a kind of Medical patient translational transferring apparatus, the length of substrate 3-5 centimetre shorter in the length of ordinary hospital bed or stretcher, two described lateral struts are connected below packaged type bed board, 3-6 roller is installed below every root lateral struts, two lateral struts are positioned at the middle part of packaged type bed board, also comprise track plates, track plates comprises the transverse slat of two block-shaped identical high strength and is fixedly connected with or integrated stringer board with two pieces of transverse slats, the length 15-30 centimetre longer than the width of packaged type bed board of transverse slat, the length of stringer board is equal with the distance of two lateral struts.

Patent Publication U.S. Pat. No. 5,067,188A discloses a sliding transfer device comprising a lower support plate and an upper seat. The upper seat is pivotally attached to the lower support plate to slide over the top surface of the plate. A person being transferred from one location to another, such as the edge of a bed to a wheelchair seat, is placed upon the upper seat, and is transferred as the seat slides across the top surface of the lower support plate. The lower support plate may be straight, curved, or S-shaped.

Patent Publication No. U.S. Pat. No. 6,374,435B1 discloses a manually-powered patient conveyor is disclosed in the form of a continuous belt which reduces friction beneath the patient to enable lateral patient transfer from one patient support surface to another. With the belt positioned beneath the patient, a caregiver can readily grip circumferencial handles on the belt to help pull the patient sideways from one surface to another, while borasilicate glass microbubbles or other lubricants are dispersed on the interior of the sleeve-like belt to further minimize friction during patient transfer.

Patent Publication No. U.S. Pat. No. 8,096,003B2 discloses a transporting device for patients who are to be transported from a first site to a second site using low force. For this purpose is provided a firm board which can also be resilient, wherein this board is encompassed by an endless band. This endless band is adapted to the shape of the board and can slide around the board. The outer ends of the board are provided with caps which, on the one hand, lend the board high rigidity at the ends and, on the other hand, prevent body fluids from penetrating into the interspace between board and endless band.

Above mentioned prior arts and most commercially available devices however, have been found to suffer from multiple drawbacks, including non-portability, high manufacturing cost, complicated to use, injure the patient's body while lateral transfer or takes substantial time to set up for single time lateral transfer etc.

There is accordingly a need for a device for lateral transfer of patients that offers a low force lateral transfer solution for caregiving staff or nurses in hospitals, especially in cases where the patient is non-cooperative, a bedridden elderly person, a patient under general anaesthesia or in coma or a patient resistant to mobilization. Also sometimes patients are agitated, combative, non-responsive, or can offer limited levels of cooperation increasing the risk for injury. It is yet another object of the present invention to reduce the amount of assistance required in transferring patient from one bed to another. These and other objectives are accomplished by transfer described herein below.

SUMMARY OF THE INVENTION

The present invention relates to an apparatus for gravity assisted lateral transfer of patient. In particular the invention provides an apparatus for lateral transfer of patient that facilitates gravity assisted transfer of patient with low effort and high protection from injury.

In an embodiment, the invention comprise a curved board for gravity assisted lateral transfer of patient comprising a top surface and a bottom surface having rectangular holes punched at the ends of the curved board. The curved board is made of substantially rigid material for the purpose of smoothly sliding the patient's body from the operating table (first flat surface) to a moveable bed (second flat surface). The z-shaped sliding board may be made of any strong material with smooth surface i.e. High-Density PolyEthylene, Fiber Glass, stainless steel, or similar other materials. The z-shaped curved board has an appropriate size such that when it is placed beneath the patient's body it spans the area from head to legs and bridges from first flat surface to second flat surface in such a way that with the two flat surfaces levelled at different heights it forms a curved slope from first flat surface to second flat surface on which the patient can be moved/transferred laterally with minimal effort from the nursing staff who assist the move due to the gravity induced motion provided by the slope.

In an embodiment of the invention, the curved board comprise of an elevated portion, a middle slanted portion, and a lower portion wherein the elevated portion is substantially raised relatively to the lower portion. The curved board may be substantially wide enough to provide a sliding platform for atleast upper half body of the patient.

In an embodiment of the present invention, the first flat surface or operating table may have one or more piece of fabric above it as bedding. The second flat surface or moveable bed may be configured such that it is levelled relatively below the level of first flat surface.

In an embodiment of the present invention, the elevated portion of the curved board can be configured to shove beneath the said fabric and the lower portion of the curved board can rest on flat surface of the adjacent low levelled second flat surface.

In an embodiment of the present invention, gravity assisted lateral transfer of patient is performed by gently sliding the patient from the elevated surface to the lower surface via the slanted surface.

In yet further embodiments of the present invention, the first flat surface or operating table can be slightly tilted by manual or electronic means to facilitate sliding of patient on the curved board.

In an embodiment of the present invention, upper surface of the curved board may be configured to be smooth textured and bottom surface may be configured to have relatively high friction.

In an embodiment of the present invention, the fabric or protection sheet used as bedding on the first flat surface comprise an upper surface made with an absorbent material/fabric and bottom surface of the fabric sheet is made of a low-friction material/fabric.

One or more of the holes may in an embodiment be disposed along the opposite sides of the curved board for the purpose of carrying or placing the curved board.

BRIEF DESCRIPTION OF THE ACCOMPANYING DRAWINGS

DESCRIPTION OF THE PREFERRED EMBODIMENTS

Figure 1:
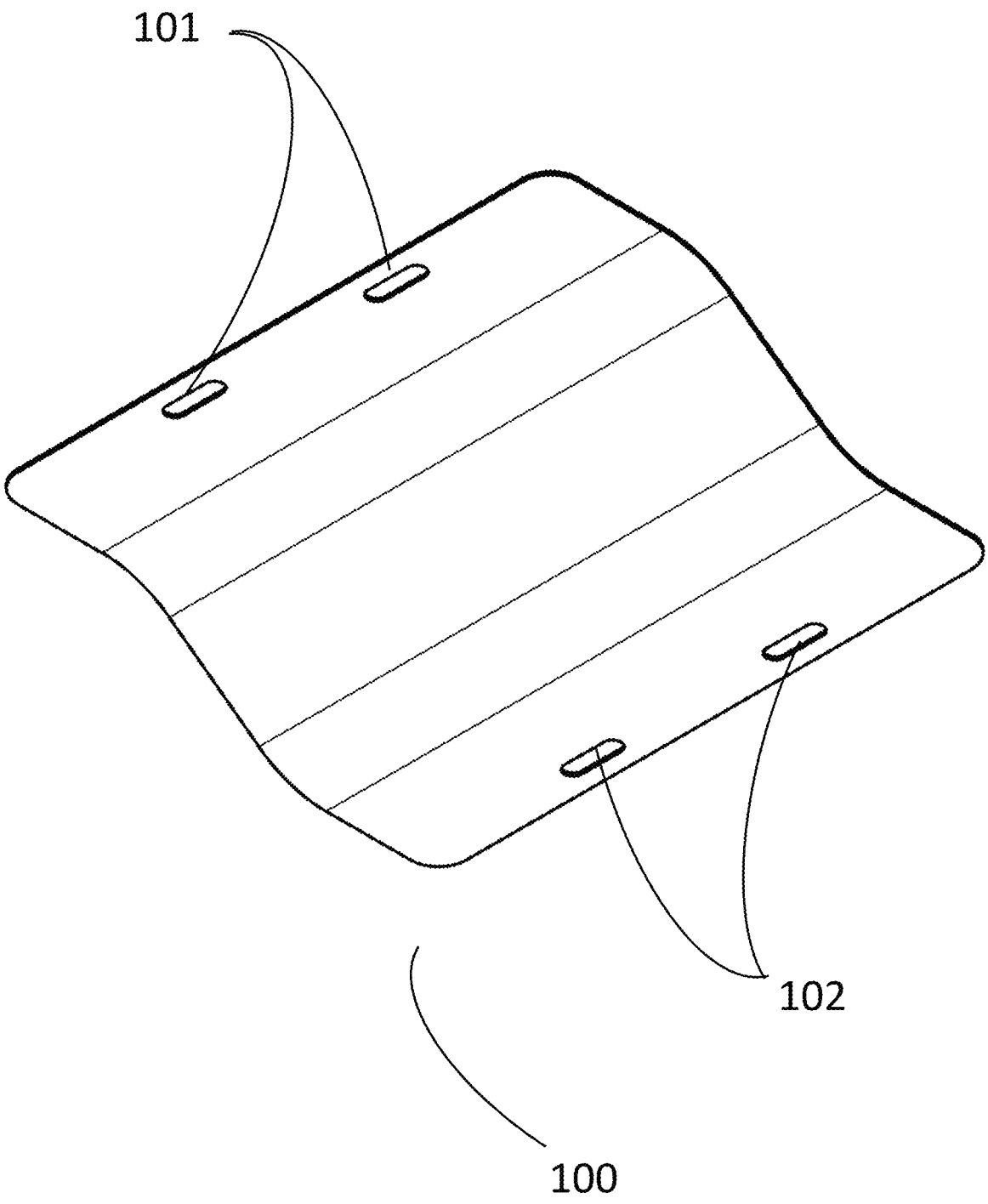
FIG. 1 illustrates top perspective view of the embodiment of patient transfer device.
Figure 2:
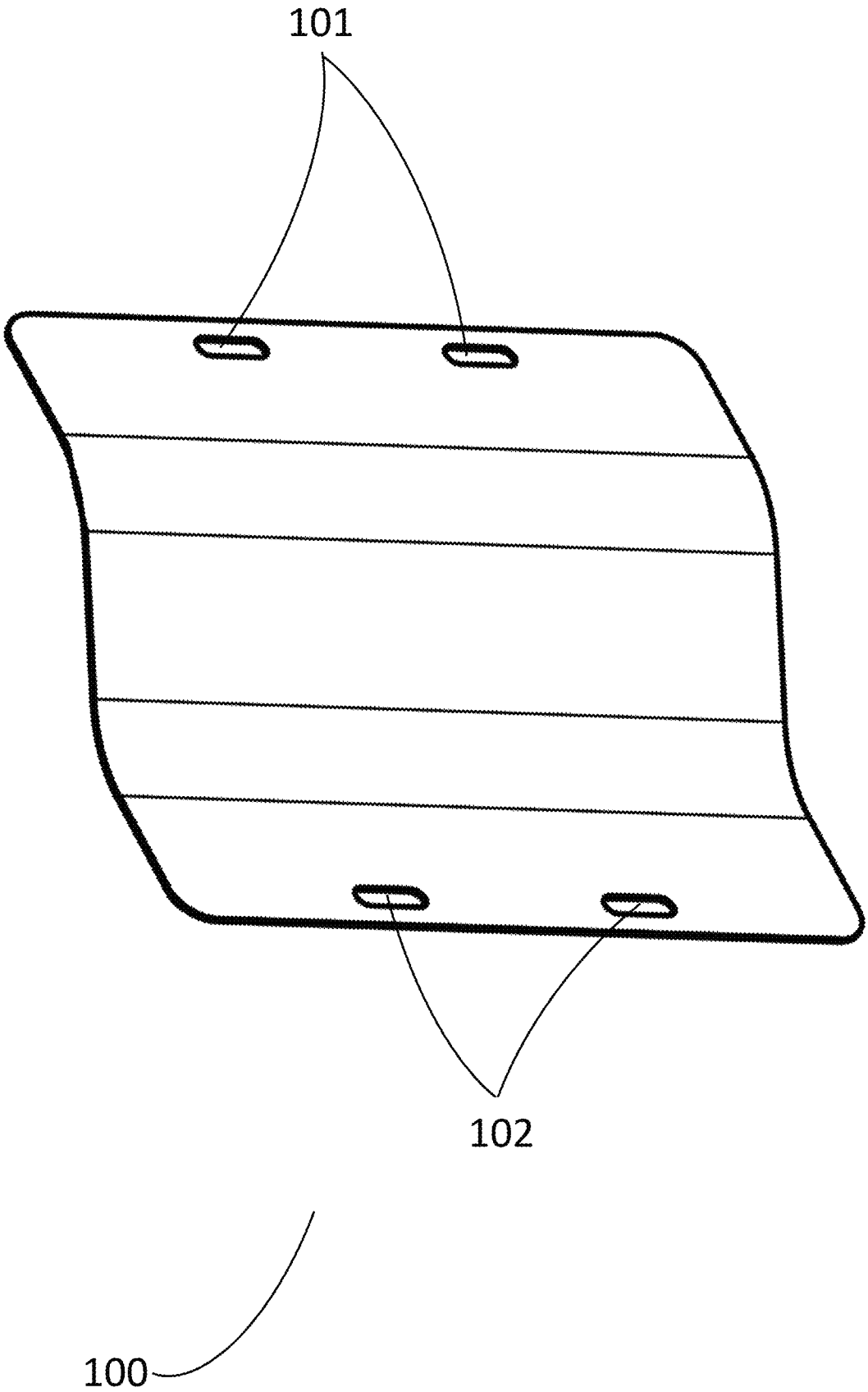
FIG. 2 illustrates top plan view of the embodiment of patient transfer device.
Figure 3:
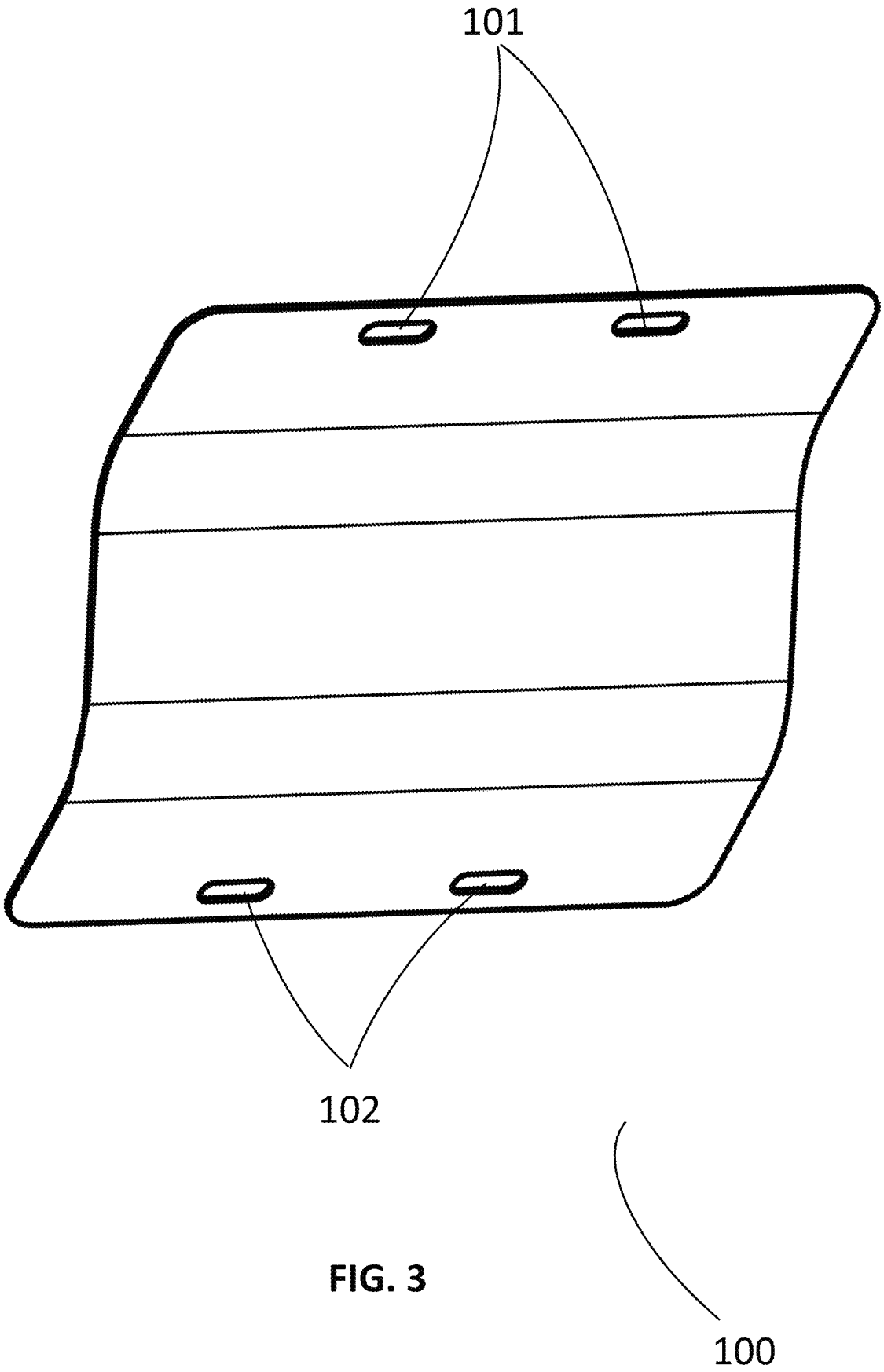
FIG. 3 illustrates bottom plan view of the embodiment of patient transfer device.

The present invention relies on the recent findings that most activities of practical nurses and caregivers were frequent transfer of patients in beds, and moving patients in beds, and the changing posture or position of the patients at an average of 15 to 16 times per day. During this caregiving activity most nurses and caregivers get exposed to risk of work-related musculoskeletal disorders while performing lateral transfer of patients due to factors like excessive reaching, pushing or pulling, bending, awkward posture/position, excessive load particularly effecting back, shoulders, hands, knees of nurse and caregivers.

During lateral transfer patients also get exposed to risk patients cannot be lifted like loads as patient's body is bulky and has asymmetric distribution of weight and do not possess available, stable areas to grip, thus it is not possible to predict what will happen while handling a patient. If not handled properly, the patient and even staff may slip, trip or fall which can cause serious injury to both. In small congested hospitals there may also be dearth of spaced due to small room or lots of equipment which may necessitate awkward positions and postures making the lateral transfer patient even more complicated to perform. There are other risk factors also that affect the process of lateral transfer of patient like no assistance available, inadequate equipment, lack of knowledge or training.

Therefore, it is recommended that manual lifting of residents should be minimized in all cases and eliminated when feasible. The use of effective patient handling aids should be always encouraged.

The present invention comprises a curved z-shaped board that offers gravity assisted lateral transfer of patient. The invention in an embodiment comprises a top surface and a bottom surface having rectangular holes punched at the ends of the curved board. The curved board is made of substantially rigid material for the purpose of smoothly sliding the patient's body from the operating table (first flat surface) to a moveable bed (second flat surface). The z-shaped sliding board may be made of any strong material with smooth surface i.e. High-Density PolyEthylene, Fiber Glass, stainless steel, or similar other materials. The z-shaped curved board has an appropriate size such that when it is placed beneath the patient's body it spans the area from head to legs and bridges from first flat surface to second flat surface in such a way that with the two flat surfaces levelled at different heights it forms a curved slope from first flat surface to second flat surface on which the patient can be moved/transferred laterally with minimal effort from the nursing staff who assist the move due to the gravity induced motion provided by the slope.

Additional features and advantages of the invention will be set forth in the description which follows, and in part will be obvious from the description, or may be learned by the practice of the invention. These and other features of the present invention will become more fully apparent from the following description, or may be learned by the practice of the invention as set forth hereinafter.

FIGS. 1 to 5 illustrates various embodiments of the curved z-shaped board 100.

The embodiment of the curved z-shaped board 100 illustrated in FIG. 1 comprise a top surface and a bottom surface having rectangular holes 101 and 102 punched along the opposite sides of the curved board 100 for the purpose of providing grip for carrying or placing the curved board. The curved board 100 is made of substantially rigid soft textured material for the purpose of smoothly sliding the patient's body from the operating table (first flat surface) to a moveable bed (second flat surface). The curved board is rigid enough to withhold the weight of any adult patient body and doesn't get deformed by body weight of the patient while performing his/her lateral transfer.

Figure 4:
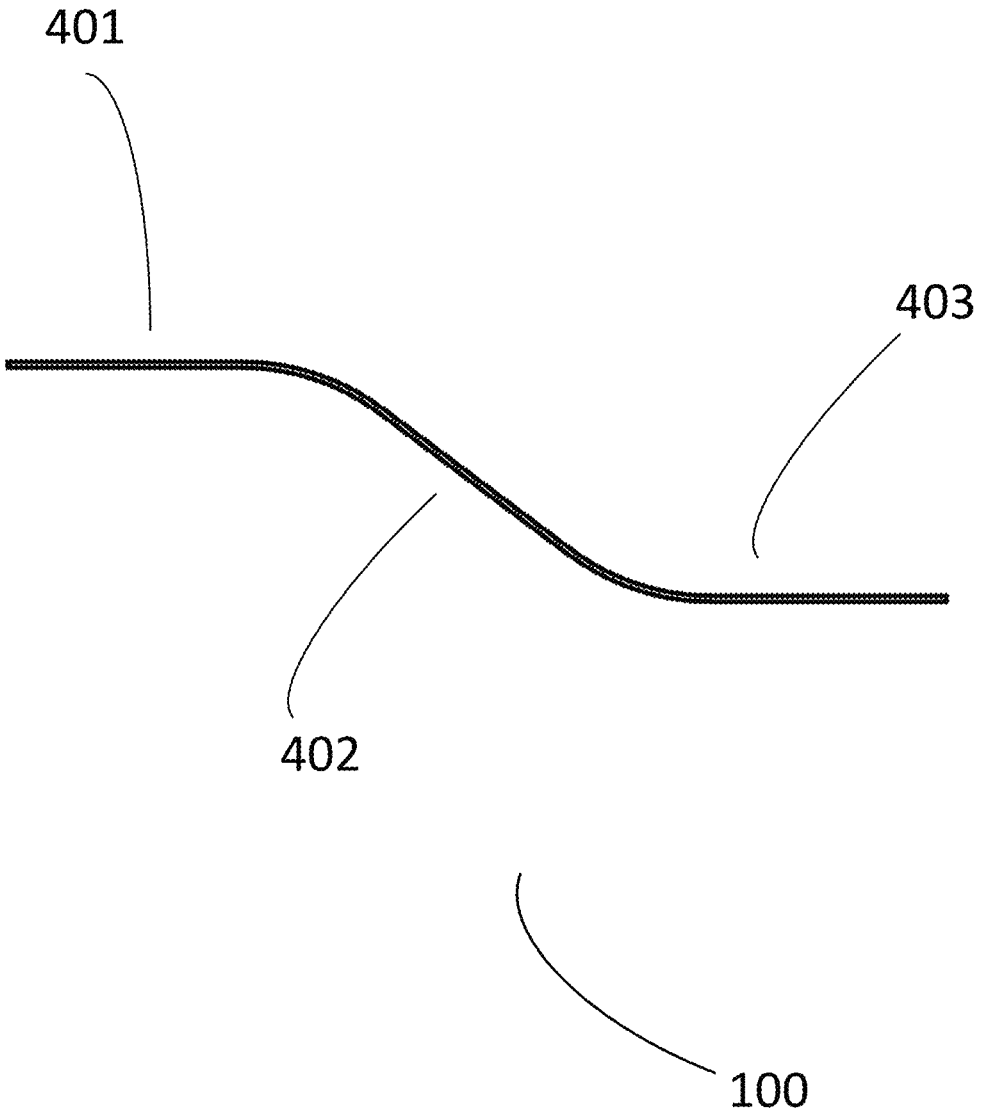
FIG. 4 illustrates right side view of the embodiment of patient transfer device.
Figure 5:
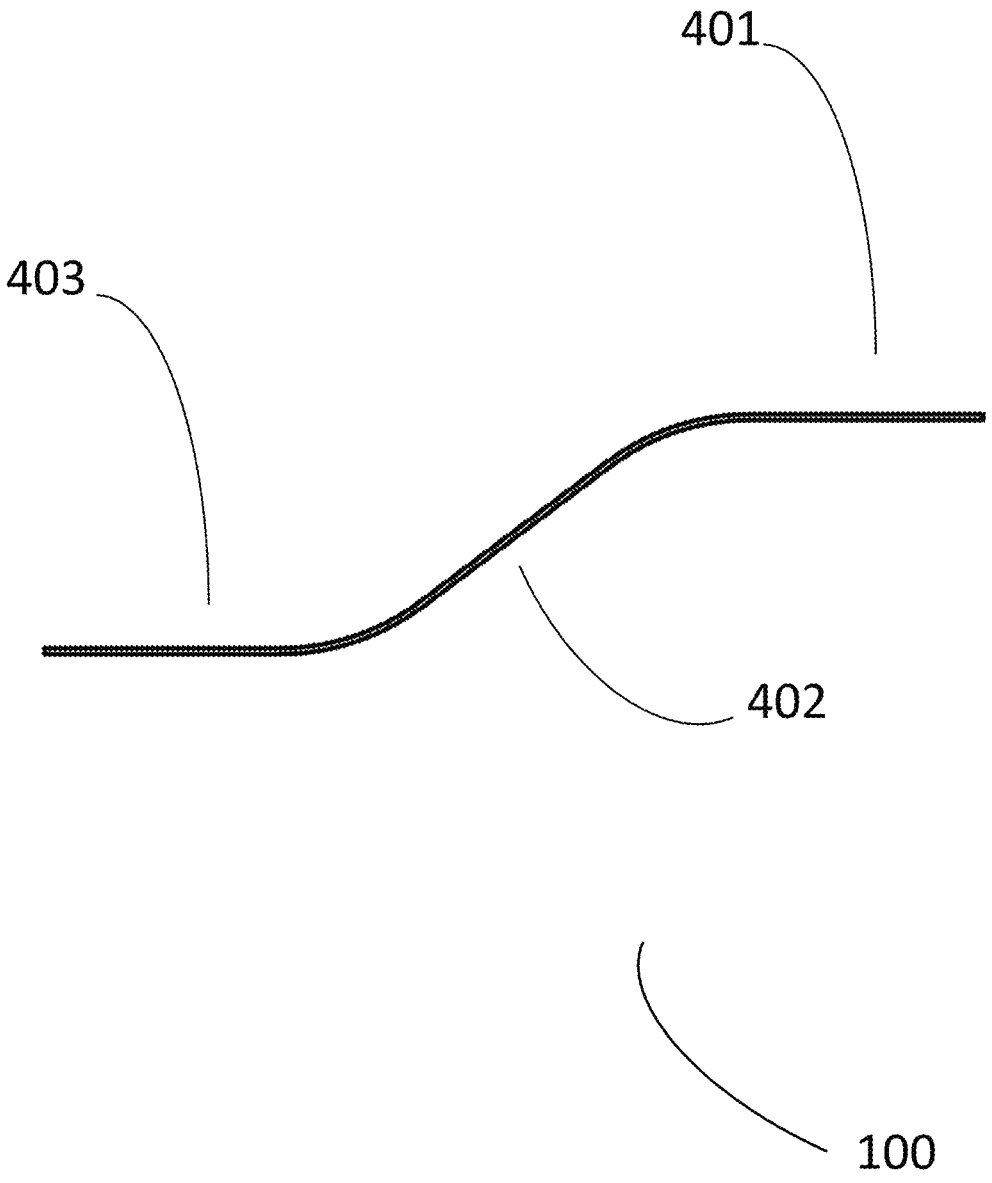
FIG. 5 illustrates left side view of the embodiment of patient transfer device.
Figure 6:
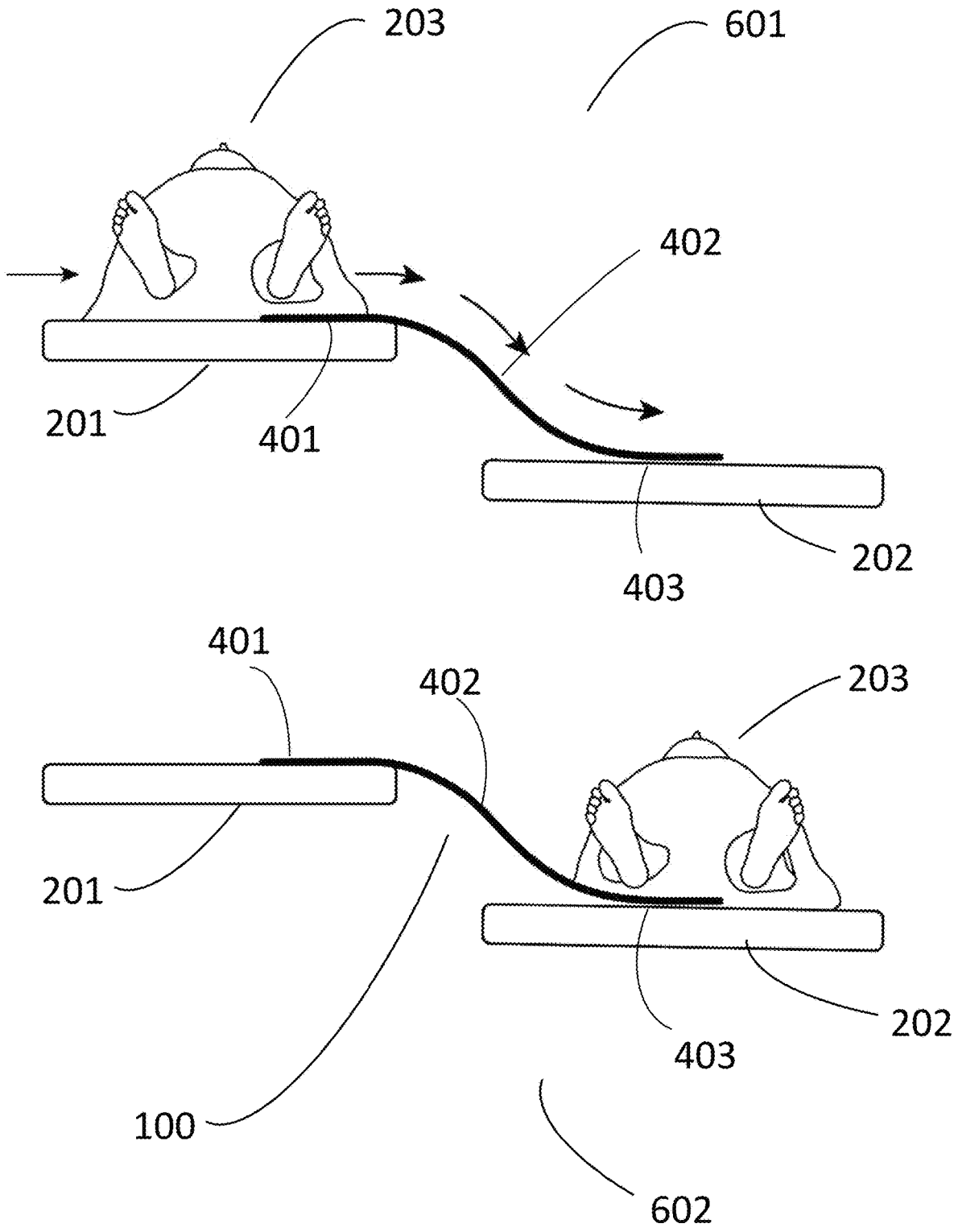
FIG. 6 illustrates an intended use of the patient transfer device.

FIGS. 4 and 5 illustrates side view of the z shaped curved board 100 wherein the curved board comprise of an elevated portion 401, a middle slanted portion 402, and a lower portion 403 wherein the elevated portion 401 is substantially raised relatively to the lower portion 403 thereby forming a curved shaped board which can facilitate gravity assisted sliding lateral transfer of patients by sliding patient from elevated portion 401 to lower portion 403 through slanted portion 402. The curved board 100 may be substantially wide enough to provide a sliding platform for atleast head to feet area of an average human body FIG. 6 illustrates an exemplary embodiment of the present invention. The embodiment describes an initial position 601 of the patient 203 wherein the patient 203 is lying on first flat surface or operating table 201 and final position 602 which is intended to be achieved by performing successful lateral transfer of patient 203 using z shaped curved board 100. The first flat surface or operating table 201 on which patient 203 is lying may have one or more piece of fabric above it as bedding. A second flat surface or bed 202 is placed adjacently to the second flat surface B or moveable bed may be configured such that it is levelled relatively at 4-6 inches below the level of first flat surface. In order to transfer the patient from initial position 601 to final position 602 the elevated portion 401 of the curved board 100 is configured to shove beneath the said fabric upon which patient 203 is lying and the lower portion 403 of the curved board 100 can rest upon the adjacent low levelled second flat surface 202. Once the z shaped curved board 100 is properly configured, the gravity assisted lateral transfer of patient 203 is performed by gently sliding the patient 203 on the curved z-board 100 from the elevated portion 401 placed on first flat surface position 201 to the lower portion 403 on the second flat surface position 202 through the slanted portion 402 of z shaped curved board providing a sliding slope for gravity assisted lateral transfer of patient 203.

In yet another embodiment of the present invention, the first flat surface or operating table 202 can be slightly tilted by manual or electronic means to facilitate nurses assistive sliding of patient 203 on the curved board 100.

Figure 7:
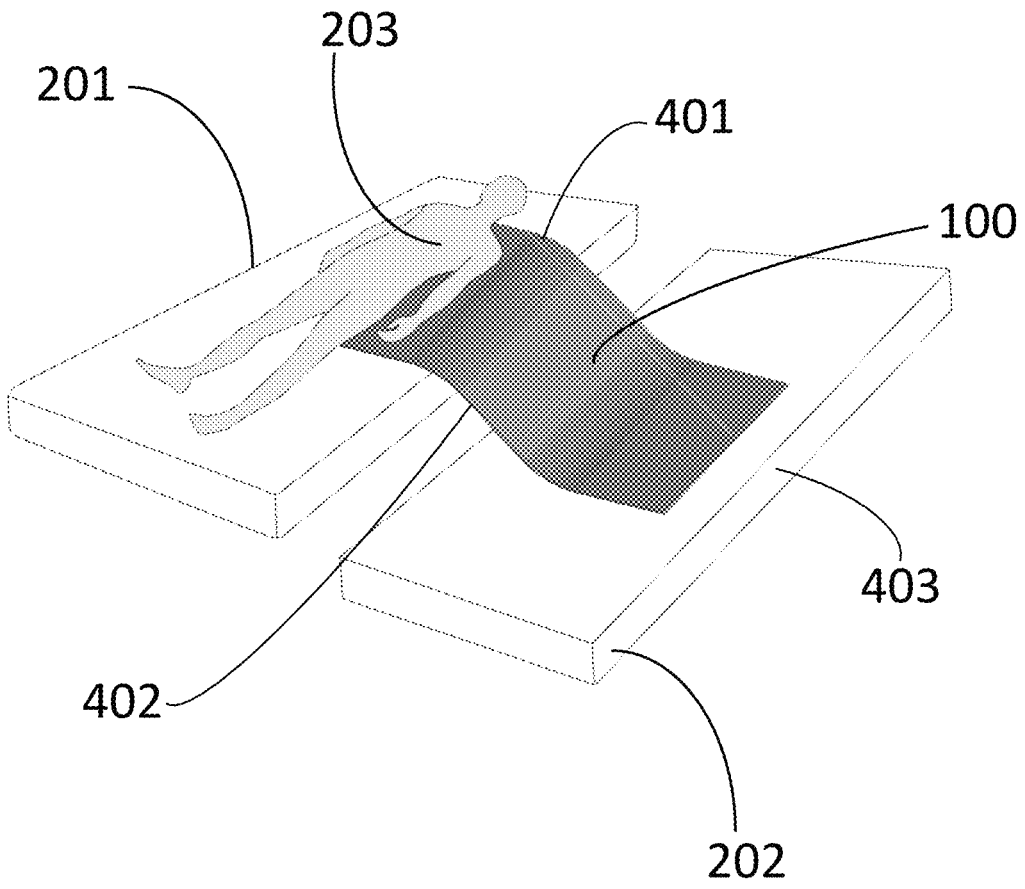
FIGS. 7 and 8 illustrates patient on the patient transfer device in the initial position.
Figure 8:
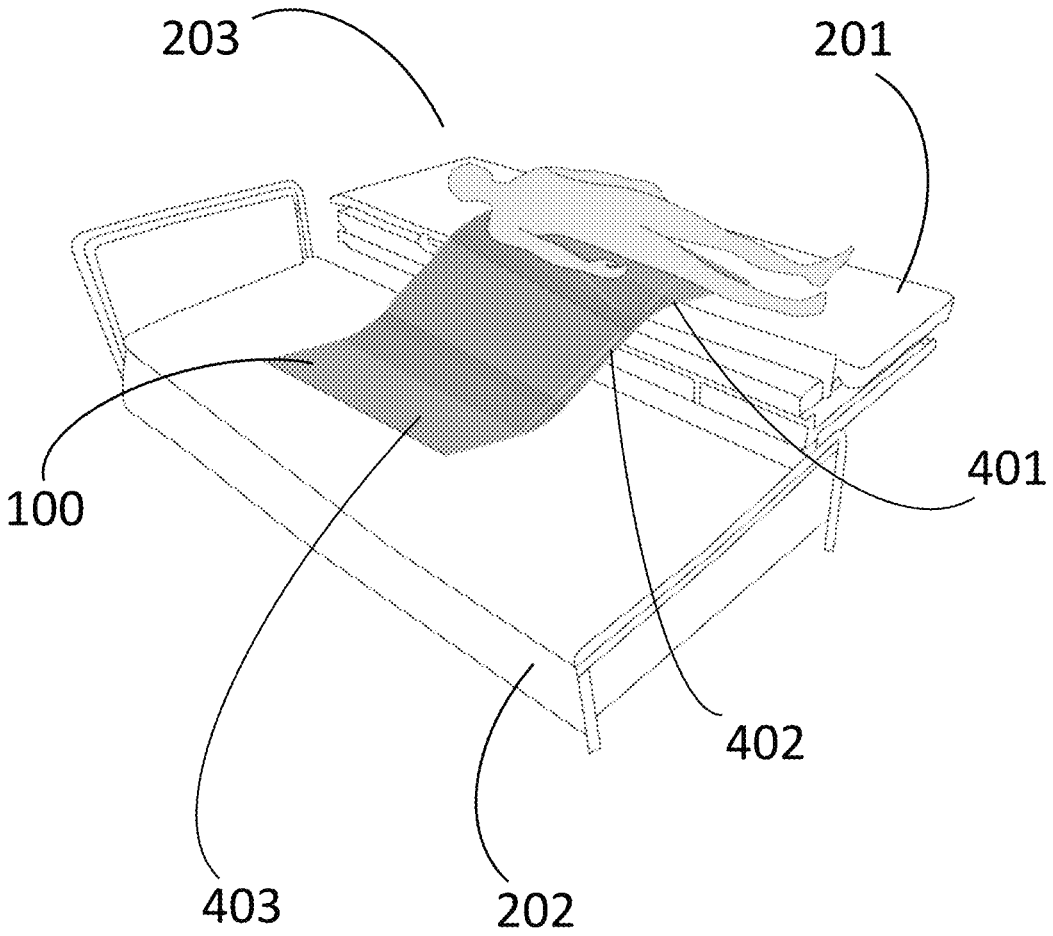

FIGS. 7 and 8 illustrates an embodiment of the present invention describing the best method of placing the z-shaped curved board 100. The z-shape curved board 100 has to be shoved beneath the fabric on which patient 203 is lying and the lower portion of the z-shaped curved board 100 is made to rest upon the adjacent low levelled second flat surface 202 in order to facilitate gentle sliding of the patient on the z-shaped curved board 100 from the first flat surface 201 position to the second flat surface position 202. The ideal placement of z-shaped curved board 100 has to be done in a manner that elevated portion rest at the middle of the first flat surface 201 and the lower portion rest at the middle of the second flat surface 202.

Figure 9:
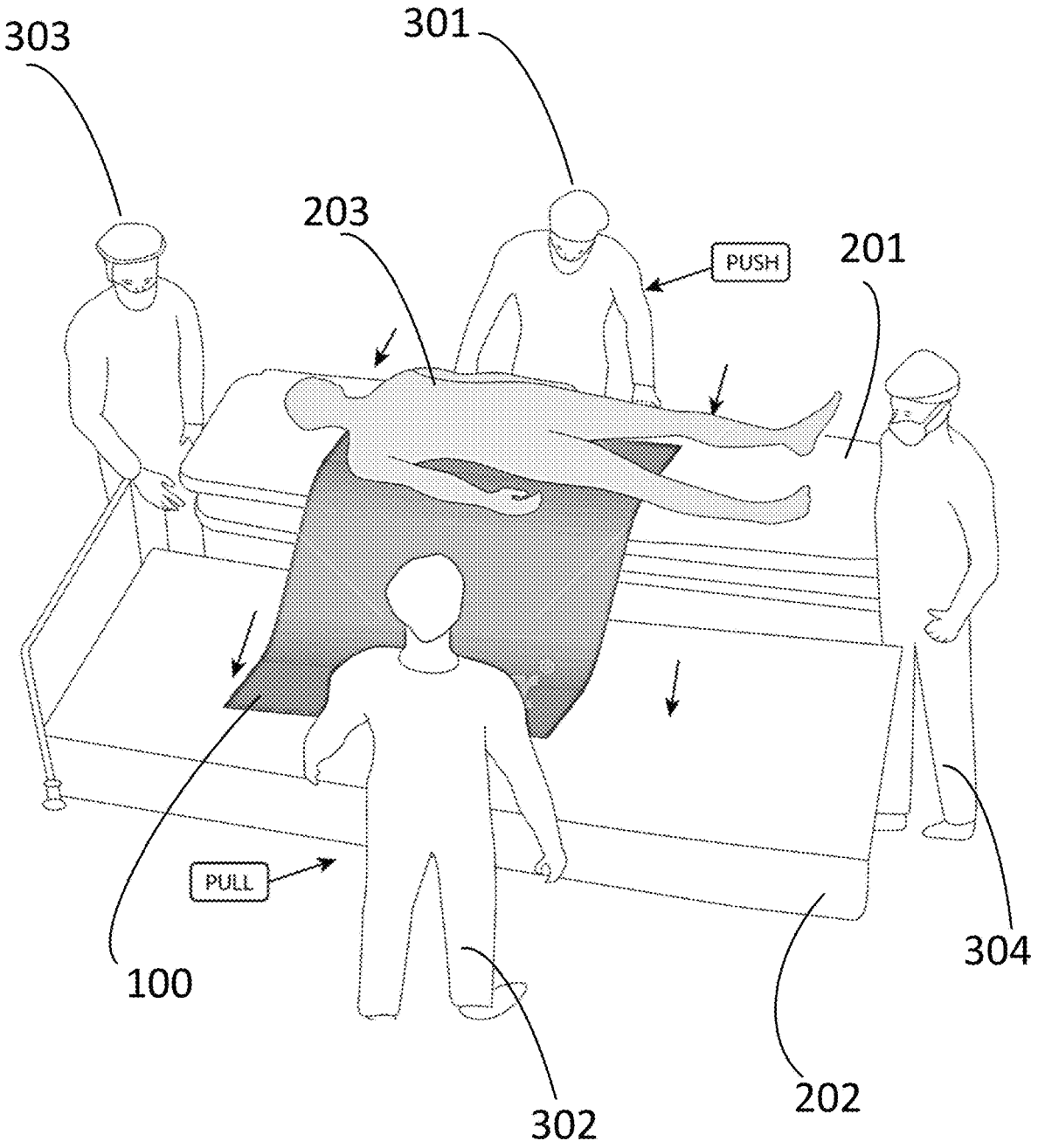
FIGS. 9 and 10 illustrates exemplary mechanism of transferring patient using patient transfer device.
Figure 10:
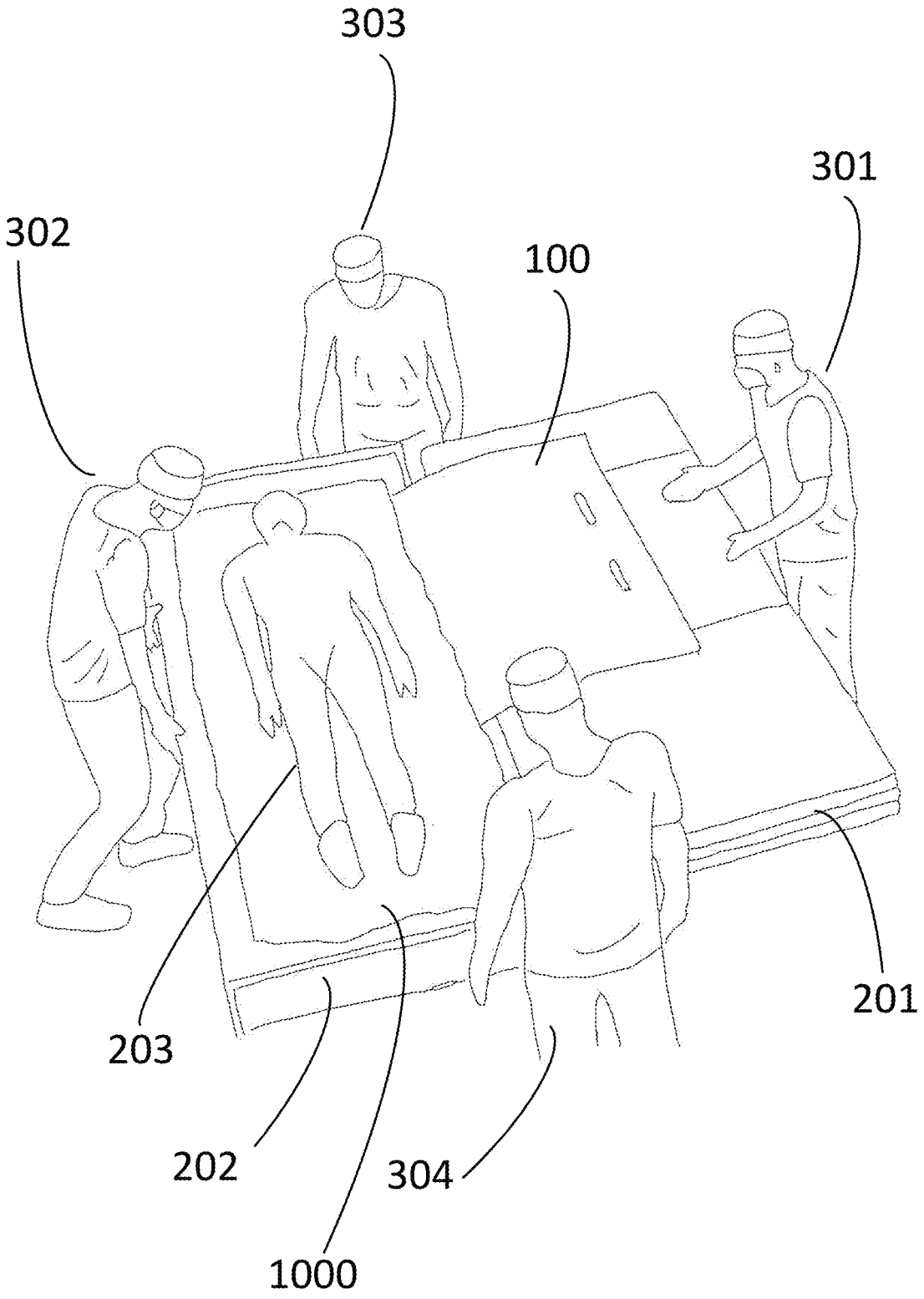

FIGS. 9 and 10 illustrates an embodiment of the present invention describing the best method of performing lateral transfer of patient 203 by practical nurses or caregivers using z-shaped curved board. For safety it must be ensured that there are at least four nurses or caregiver to involve in lateral transfer of the patient. The positioning of four nurses such that first nurse 301 should stand at the side of first flat surface 201 i.e. (patient's side) for gently pushing the patient 203 over the z-shaped curved board 100, the second nurse 302 should stand at the side of second flat surface 202 such that second nurse 302 is standing opposite facing the first nurse 301 in order to gently pull the patient 203 while the first nurse 301 is pushing. The third nurse 303 and fourth nurse 304 should be standing near the head and legs of patient respectively for holding the patient 203 and assisting the first nurse 301 and second nurse 302 during gravity based lateral transfer of patient 203. The z-shaped curved board 100 ensures that lateral transfer of patient 203 can be performed safely by nurses using low muscular force without exposing nurses and patient 203 to potential injury during this process.

In an embodiment of the present invention as illustrated in FIG. 10, after the patient 203 has been transported from first flat surface 201 i.e. operating table to second flat surface 202 i.e. moveable bed the nurse can move the second flat surface 202 or moveable bed away to remove the z-shaped curved board 100.

In particular embodiment of the present invention, upper surface of the z-shaped curved board 100 may be configured to be smooth textured and bottom surface may be configured to have relatively high friction.

In an embodiment of the present invention, the fabric or protection sheet 1000 used as bedding for first flat surface 201 on which patient 203 is lying may comprise an upper surface made of absorbing material/fabric and bottom surface of the fabric sheet is made of a low friction material/fabric. The purpose of providing absorbing material or fabric on upper surface is manifold. Usually after long surgery, the patient might be lying on the bedsheet 1000 that got soaked wet with fluid and blood that seeped through the surgical drape during surgery. The caregiving staff wouldn't want to move that contaminated sheet with the patient 203 to a clean transporting bed 202. The ideal configuration of placing the sheet 1000 is between the patient's body 203 and the curved z-shaped board 100 for the lateral transfer. The purpose of the sheet 1000 is to protect the patient's skin from shearing or getting bruised from the z-shaped curved board 100 and to protect the z-shaped curved board from getting soiled from the fluids and blood of patients body. The ideal length of the sheet 1000 described here should be enough to provide bedding from head to feet of the patient 203. The additional purpose of providing absorbing material on the top surface is to absorb body moisture and sweat of a patient lying on sheet from a long duration. The bottom surface should be low-friction for the ease of lateral transfer. The bottom surface is provided with a low friction surface in order to keep it stick to the first flat surface 201 and don't let it get displaced unnecessarily thereby providing hassle free experience while performing lateral transfer of patient to second flat surface 202.

In yet another embodiment, one or more of the holes 101 and 102 may be disposed along the opposite sides of the curved board 100 for the purpose of carrying or placing the curved board.

By virtue of implementing the above embodiments, the invention provides a device 100 capable of gravity assisted low force lateral transfer solution. Additionally, the invention provides a low cost, portable solution that is capable of being used by a subject at home or in a hospital or clinic, and which facilitates gravity assisted low force transfer of the patient from one flat surface to other flat surface.

While the exemplary embodiments of the present invention are described and illustrated herein, it will be appreciated that they are merely illustrative. It will be understood by those skilled in the art that various modifications in form and detail may be made therein without departing from or offending the spirit and scope of the invention as defined by the appended claims. Additionally, the invention illustratively disclosed herein suitably may be practiced in the absence of any element which is not specifically disclosed herein—and in particular embodiment specifically contemplated, is intended to be practiced in the absence of any element which is not specifically disclosed herein.

The invention claimed is:

1. A curved board for gravity assisted lateral transfer of patient comprising:

said curved board being formed of substantially rigid material;

said curved board having a planar elevated portion;

said curved board having a planar lower portion;

said curved board having a slanted portion connected in an engagement between said planar elevated portion and said planar lower portion;

said curved board having a top surface and a bottom surface;

said curved board removably postionable to a patient transfer positioning having said planar elevated portion sandwiched in-between a patient and a first flat surface supporting said patient, and having said planar lower portion supported atop a second flat surface positioned at a lower elevation than said first flat surface;

said engagement of said slanted portion between said planar elevated portion and said planar lower portion being substantially rigid to hold said planar elevated portion and said planar lower portion in respective fixed engagements therewith, said fixed engagements maintaining said planar elevated portion substantially parallel to said planar lower portion;

a slide protection sheet positionable in-between said patient and said top surface;

said slide protection sheet having an upper surface formed of fluid absorbing material and having a bottom surface formed of a low friction material; and whereby said slanted portion defines a substantially planar ramp extending between said planar elevated portion to said planar lower portion for sliding said patient thereupon from said first flat surface to said second flat surface.

2. The curved board for gravity assisted lateral transfer of patient according to claim 1, further comprising:

a first pair of openings formed through said planar elevated portion at a first edge thereof, said first edge thereof being opposite a second edge thereof in said connection of said planar elevated portion to said slanted portion; and a second pair of openings formed through said planar lower portion at a first edge thereof, said first edge thereof being opposite a second edge thereof in said connection of said planar lower portion to said slanted portion.

* * * * *